US005284984A

United States Patent [19]

Dessau et al.

[11] Patent Number: 5,284,984

[45] Date of Patent: Feb. 8, 1994

[54] GASOLINE UPGRADING BY AROMATICS AMINATION

[75] Inventors: Ralph M. Dessau, Edison; Quang N. Le, Cherry Hill; Samuel A. Tabak; Robert T. Thomson, both of Voorhees, all of N.J.

[73] Assignee: Mobil Oil Corporation, Fairfax, Va.

[21] Appl. No.: 998,807

[22] Filed: Dec. 29, 1992

[51] Int. Cl.[5] ..... C07C 5/02; C07C 5/22

[52] U.S. Cl. ..... 585/253; 585/310; 208/49; 208/144; 564/419; 564/420

[58] Field of Search ..... 585/310,254,300,302, 585/253; 208/144, 145, 49; 564/420, 419, 421, 422

[56] References Cited

U.S. PATENT DOCUMENTS

| | | | |
|---|---|---|---|
| 2,402,423 | 6/1946 | Mason | 260/580 |
| 2,402,439 | 6/1946 | Owen et al. | 260/580 |
| 2,402,440 | 6/1946 | Owen et al. | 260/580 |
| 2,415,817 | 2/1947 | Gohr et al. | 260/580 |
| 2,421,608 | 6/1947 | Gohr | 260/580 |
| 2,432,087 | 12/1947 | Brown | 260/580 |
| 4,746,420 | 5/1988 | Darian et al. | 208/289 |

OTHER PUBLICATIONS

J. F. Kung et al., "Production of Xylidines by High Pressure Hydrogenation", Esso Standard Oil Company (Louisiana Division),(Aug. 1948).

G. H. Unzelman, et al., "Are There Substitutes For Lead Anitknocks?", American Petroleum Institute's Division of Refining (1971).

C. L. Brown et al., "Production of Xylidines by High Pressure Hydrogenation", Standard Oil Development Co., (1948).

T. Iida, "Aromatic Aminer as Antiknock Compounds", Japan Petroleum Inst. Journal, (1971).

DeLargey, R. J. et al., "New Xylidine Process Revealed", Shell Publishing Corp., (1948).

"Arylamines", Industrial and Engineering Chemistry, (1948).

*Primary Examiner*—Anthony McFarlane

*Attorney, Agent, or Firm*—Alexander J. McKillop; Dennis P. Santini; Laurence P. Hobbes

[57] ABSTRACT

A method for upgrading an aromatics-containing charge composition boiling in the gasoline boiling range comprises i) contacting the charge composition with a nitrating agent under nitrating conditions to form a product comprising nitrated aromatics; ii) hydrogenating a feed containing the product of i) under conditions sufficient to substantially reduce the nitro group of the nitrated aromatics so as to form a product comprising aromatic amines, water and heavy amines; and iii) removing the water and heavy amines from the product of step ii) to provide a gasoline boiling range product of an octane rating greater than the charge composition.

10 Claims, 3 Drawing Sheets

GASOLINE UPGRADING BY AROMATICS AMINATION

FIELD OF THE INVENTION

This invention relates to a process for upgrading naphtha to a higher octane product by converting aromatic hydrocarbons to corresponding aromatic amines.

BACKGROUND OF THE INVENTION

The demand for gasoline as a motor fuel is one of the major factors which dictates the design and mode of operation of a modern petroleum refinery. The gasoline product from a refinery is derived from several sources within the refinery including, for example, gasoline from the catalytic cracking unit, straight run gasoline, gasoline obtained as a low boiling by-product from various refinery operations, especially catalytic processes such as catalytic dewaxing, and reformate. The octane number of the gasoline from these different sources varies according to the nature of the processing and the octane rating of the final gasoline pool will depend upon the octane ratings of the individual components in the pool as well as the proportions of these components. The increasing use of unleaded gasoline coupled with increasing engine efficiencies in road vehicles has led to a demand for increased gasoline pool octane which, in turn, makes it desirable to increase the octane values of the individual components of the pool. Although there are various ways of achieving this objective, some necessarily involve compromises which may render them less attractive in commercial refinery operation. For example, the octane rating of straight-run naphtha may be improved by reforming over a noble metal/acid catalyst, which converts aliphatic and cycloaliphatic hydrocarbons to higher octane aromatics. However, such treatment can entail a significant yield loss resulting from deleterious side reactions such as cracking and coking. Alternative measures for increasing pool octane are therefore still desirable.

Another trend which is perceptible in the petroleum refining industry is towards the reduction of benzene and other aromatics in the gasoline pool. In the United States, the Clean Air Act specifies various motor fuel content standards and similar measures are being considered in the European Community. Benzene is particularly prevalent in reformer gasoline, being a distinctive product of the reforming process, produced by the dehydrogenation of $C_6$ cycloparaffins, the dehydrocyclization of straight chain paraffins of appropriate chain length ($C_6$) and dealkylation of other aromatics. Accordingly, it would be desirable to provide an alternative to reforming of naphtha which would provide the desired increase in octane without increasing aromatics content or decreasing yield. It would also be desirable to treat a reformate prepared under low severity conditions which avoid severe yield losses, by enhancing its octane values without increasing aromatics content.

Aromatic amines possess higher blending octane values than their hydrocarbon analogues so that they are desirable components for the refinery gasoline pool. Amination of aromatic components present in a gasoline boiling range feedstock therefore represents an attractive means for providing a significant improvement in the octane rating of the gasoline pool without increasing its aromatics content. Preparation of aromatic amines by reducing nitro compounds is known in the art. The reduction of nitro compounds with hydrogen can be carried out in vapor or liquid phase over a variety of hydrogenation catalysts. Further information on these hydrogenation processes is found in Kirk-Othmer, Encyclopedia of Chemical Technology, Third Ed., Vol. 2 at pp. 355–376, in an article entitled "Amines by Reduction."

SUMMARY OF THE INVENTION

We have now devised a processing scheme which is capable of providing a way of upgrading the octane rating of aromatics-containing gasoline boiling range compositions, e.g., straight-run naphtha, without increasing aromatics content, while minimizing yield losses.

In one embodiment, the present invention relates to a method for upgrading an aromatics-containing charge composition boiling in the gasoline boiling range comprising: i) contacting the charge composition with a nitrating agent under nitrating conditions to form a product comprising nitrated aromatics; ii) hydrogenating a feed containing the product of i) under conditions sufficient to substantially reduce the nitro group of the nitrated aromatics so as to form a product comprising aromatic amines, water and heavy amines; and iii) removing the water and heavy amines from the product of step ii) to provide a gasoline boiling range product of an octane rating greater than the charge composition.

In an alternative embodiment, the present invention relates to a method of upgrading the octane rating of an aromatics-containing charge composition boiling in the gasoline boiling range which comprises a) separating the charge composition into a light fraction containing saturated $C_5$ and $C_6$ hydrocarbons; a medium fraction containing C6–C8 aromatics and a heavy fraction containing C9–aromatics;

b) contacting the medium fraction with a nitrating agent under nitrating conditions to form a product comprising nitrated aromatics;

c) hydrogenating the product of b) under conditions sufficient to reduce the nitro groups of the nitrated aromatics so as to form a product comprising aromatic amines, water and heavy amines; and d) removing said water and heavy amines from the product of step c).

In yet another embodiment, the present invention relates to a method of upgrading the octane rating of an aromatics-containing charge composition boiling in the gasoline boiling range which comprises I) separating the charge composition into a light fraction containing saturated C5 and C6 hydrocarbons; a medium fraction containing C6–C8 paraffins, naphthenes and aromatics and a heavy fraction containing C9+ paraffins, naphthenes and aromatics;

II) reforming the medium fraction under low severity conditions sufficient to effect dehydrogenation of said naphthenes to aromatics without significant dehydrocyclization of parraffins III) contacting the product of II) with nitrating agent under nitrating conditions to form a product comprising nitrated aromatics;

IV) hydrogenating the product of III) under conditions sufficient to substantially reduce the nitro group of the nitrated aromatics so as to form a product comprising aromatic amines, water and heavy amines; and V) removing said water and heavy amines from the product of step IV).

In still another embodiment, the present invention relates to a hydrocarbon fuel composition boiling in the gasoline boiling range (C5+ to 204° C. (400° F.)) which comprises aminated reformate.

THE DRAWINGS

DETAILED DESCRIPTION

Figure 1:
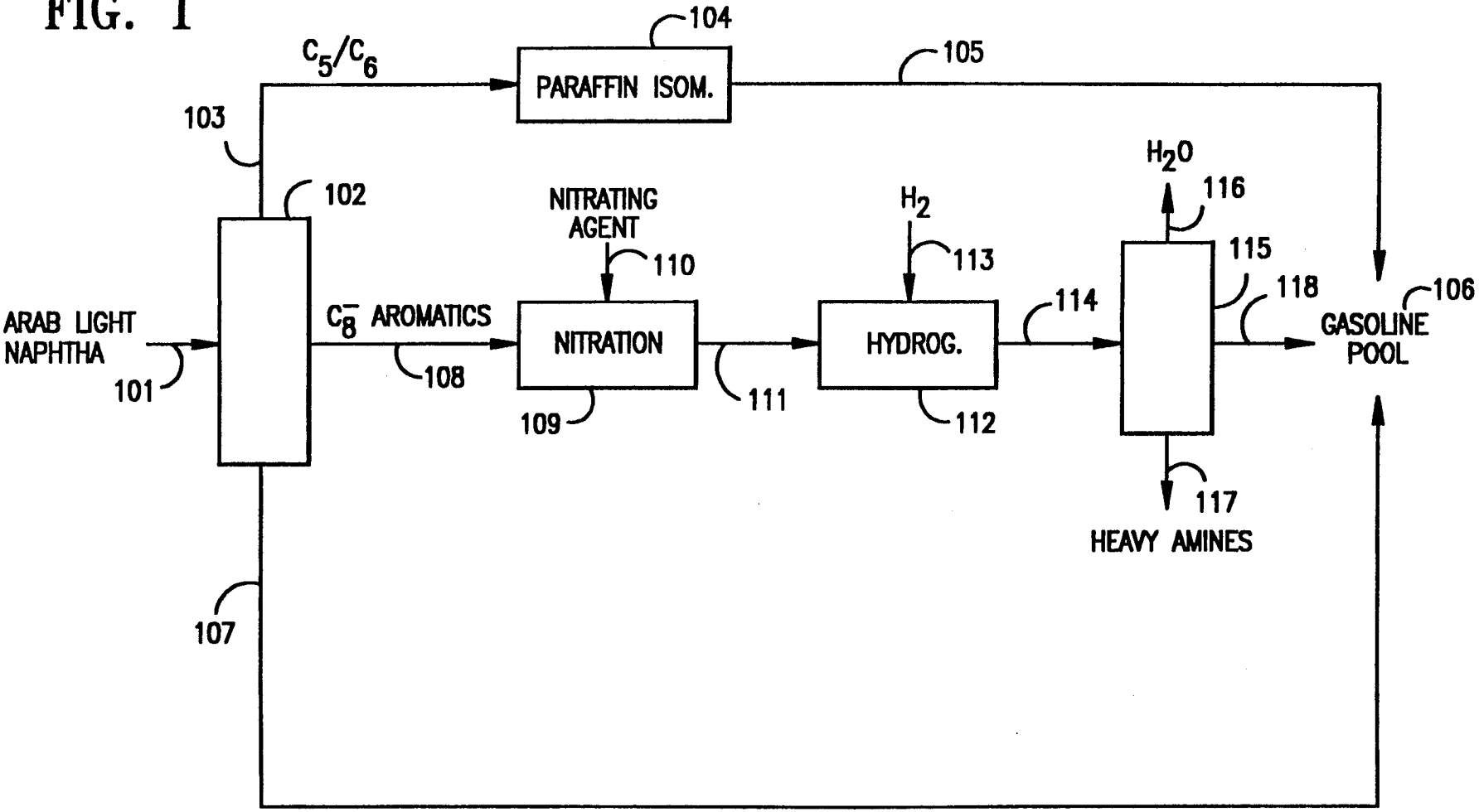
FIG. 1 is a simplified schematic flowsheet of one embodiment of the present gasoline upgrading process wherein a naphtha fraction is upgraded by amination.

In the present process an aromatics-containing gasoline boiling fraction obtained from a petroleum refinery stream is nitrated and selectively reduced to provide a product containing aromatic amines. Aromatics content of suitable feeds aminated by the present method is preferably at least 10 wt% $C_6$ to $C_8$ aromatics. The source of the gasoline boiling fraction can be a straight-run naphtha such as Arab Light, San Joaquin, Beryl, Statfjord, or Tapis. Such straight-run naphthas can contain from 10 to 35 wt% $C_6$ to $C_8$ aromatics, e.g., about 20 wt%. The composition of a typical Arab Light naphtha stream is given in Table 1 below.

TABLE 1

| 82-149° C. (180-300° F.) Arab Light Naphtha Composition | Wt. Pct. | Vol. % |
|---|---|---|
| Benzene | 1.4 | 1.1 |
| Toluene | 4.7 | 3.8 |
| $C_8$ aromatics | 6.1 | 5.2 |
| $C_9$ aromatics | 0.9 | 0.6 |
| Total Paraffins | 67.5 | 70.5 |
| Total Naphthenes | 19.8 | 18.8 |

Alternatively the gasoline boiling fraction can be a straight reformate i.e., a refinery stream which has been subjected to catalytic reforming, preferably over a reforming catalyst containing platinum. Other refinery streams containing significant quantities of aromatics and with a suitable boiling range of about $C_5$ to 203° C. (400° F.), usually $C_5$ to 165° C. (330° F.) may, however, be used. Reformates usually contain $C_6$ to $C_8$ aromatic hydrocarbons and $C_5$ to $C_6$ paraffinic hydrocarbons with the aromatic hydrocarbons being constituted mainly by benzene, toluene, xylene and ethyl benzene. Compositions for reformates which may be used in the present process are shown in Table 2 below:

TABLE 2

| | Reformate Composition | | |
|---|---|---|---|
| | Broad | Intermediate | Narrow |
| Specific Gravity | 0.72 to 0.88 | 0.76 to 0.88 | 0.76 to 0.83 |
| Boiling Range, °F. | 60 to 400 | 60 to 400 | 80 to 390 |
| °C. | 15 to 205 | 15 to 205 | 27 to 200 |
| Mole % | | | |
| Benzene | 5 to 60 | 5 to 40 | 10 to 30 |
| Toluene | 5 to 60 | 10 to 40 | 10 to 40 |
| $C_8$ Aromatic[1] | 5 to 60 | 5 to 50 | 5 to 15 |

[1]Xylene and ethyl benzene component.

The composition of a typical reformer stream from a platinum reforming process is given in Table 3 below.

TABLE 3

| Reformate Composition | Mol. Pct. |
|---|---|
| $C_4$ | 0.2 |
| $C_5$ | 15.5 |
| Non-arom. $C_6$ | 10.2 |
| Benzene | 25.8 |
| Non-arom. $C_7$ | 0.2 |
| Toluene | 34.9 |
| $C_8$ aromatics | 10.2 |
| $C_9$ aromatics | 3.0 |

As may be seen from the above figures, the aromatic hydrocarbons constitute a significant proportion of the naphtha and reformate streams and if no measures are taken to remove it, it will pass into the refinery gasoline pool unchanged. The present method provides a convenient way of converting aromatic hydrocarbons to aromatic amines which have lower vapor pressures and which contribute greatly to octane in the gasoline pool without the yield losses incurred where severe reforming conditions are used.

The aromatics-containing charge composition boiling in the gasoline boiling range, e.g., full-range naphtha or reformate, is preferably separated into a light fraction containing saturated C5 and C6 hydrocarbons; a medium fraction containing C6–C8 aromatics and paraffins and a heavy fraction containing primarily C9+aromatics. Such separation can be accomplished by simple distillation or distillation coupled with selective paraffin removal, e.g., by the Udex TM process.

In a preferred embodiment of the present invention, the medium fraction of a full range naphtha, which fraction contains paraffins, $C_8$- aromatics and $C_6$ to $C_8$ naphthenes (cycloparaffins) is subjected to low severity reforming which dehydrogenates the naphthenes without dehydrocyclization of paraffins and its accompanying deleterious side reactions, such as cracking and coking, which occur at more severe reforming conditions. Suitable low severity reforming conditions include 0.8 to 1.5 LHSV, 454°–538° C. (850°–1000° F.), 790–3550 kPa (100–500 psig), and a partial pressure of $H_2$ of 520 to 2760 kPa (75–400 psia).

In another embodiment of the present invention, the light fraction containing saturated C5 and C6 hydrocarbons is directed to a paraffin isomerization unit to increase the light fraction octane rating. Ultimately, the light fraction can be combined with the other fractions and/or added to the refinery gasoline pool to increase octane. Suitable isomerization processes include the Penez TM process of UOP.

NITRATION

The aromatics-containing charge compositions, especially the medium fractions noted above, are subjected to nitration conditions. Suitable nitrating conditions include temperatures of −20° to 120° C. (−4° to 248° F.), preferably 0° to 10° C. (32° to 50° F.), pressures sufficient to maintain liquid phase, e.g. at least 170 kPa (10 psig), and charge to nitrating acid ratios ranging from 10–90% of the stoichiometric requirement for mononitration. Suitable nitrating agents include nitric acid, as well as gaseous oxides of nitrogen, e.g., nitrogen dioxide. A suitable nitrating acid can contain nitric acid and a strong acid, e.g., sulfuric acid, perchloric acid, selenic acid, hydrofluoric acid, boron trifluoride, ionexchange resins containing sulfonic acid groups or ion-exchanging zeolites. Industrially, sulfuric acid is often used as it is highly effective and inexpensive. A particularly suitable nitrating acid comprises nitric acid, water, and sulfuric acid catalyst. Suitable nitrating acid compositions contain 10 to 50 wt% nitric acid, 20 to 80 wt% sulfuric acid and 5 to 30 wt% water. Nitration with such nitrating acids can be carried out as a batch process employing a continuous stirred tank reactor.

In a heterogenous nitrating reaction medium, the nitrating acid composition can comprise nitric acid, and an ion-exchanging catalyst comprising a zeolite. Suitable nitrating acid compositions contain 10 to 70 wt% nitric acid, 1 to 20 wt% zeolite and 5 to 70 wt% water. Suitable zeolites for carrying out heterogeneous nitrating reactions include the large and intermediate pore size zeolites, that is, zeolites which possess a constraint index of 0.5 to 12. Intermediate pore size zeolites preferably have a silica/alumina ratio of at least 12:1, as described in U.S. Pat. No. 4,016,218 (Haag). Zeolites which may be used in the manner described above are ZSM-5, ZSM-11, ZSM-12, ZSM-23, ZSM-35, ZSM-38 and ZSM-48 all of which are known materials, as discussed in U.S. Pat. Nos. 4,016,218 and 4,446,007 (Smith). Zeolite beta may also be used, as described in U.S. Pat. No. 4,419,220 (LaPierre). Other suitable zeolites include Zeolite Y and USY. These heterogeneous nitration reactions can be carried out in a fixed bed of the zeolite catalyst, preferably a downflow trickle bed reactor or a solid/liquid reactor.

In many nitrations of aromatics, an organic phase and an acid phase result. Sufficient pressure, slightly above atmospheric can be provided to maintain the liquid phases. In a two-phase system most nitroaromatics collect in the hydrocarbon phase and water in the acid phase. The reaction mixture can be fed to a separator where the organic settles to the top of the separator and is washed in several steps with dilute sodium carbonate and then water. Additional information concerning aromatics nitration processing can be found in Kirk-Othmer, Encyclopedia of Chemical Technology, Third Ed., Vol. 15 at pp. 841–853, in an article entitled "Nitration" and at pp. 916–932 in an article entitled "Nitrobenzene and Nitrotoluenes" at pp. 916–932.

HYDROGENATION

The nitrated product is hydrogenated under conditions which reduce the nitro group of nitroaromatics while substantially retaining their aromaticity. Catalytic hydrogenation is the most efficient method for hydrogenation of aromatic amines to aromatic amines. The reduction can be carried out in liquid-phase or vapor phase in the presence of a hydrogenation catalyst such as copper oxide, sulfides of nickel, molybdenum, or tungsten, and palladium-vanadium/lithium-aluminum spinels. Nitrated aromatics can be fed to the reactor as a liquid where they are heated and mixed with a hydrogen stream. Especially preferred catalysts include palladium supported on charcoal, or Raney nickel. Suitable conditions for hydrogenation include temperatures of 0° to 300° C. (32° F. to 572° F.), say, 20° to 150° C. (70° to 300° F.), preferably 40° to 60° C. (104° to 140° F.); total pressures of 100 to 10,000 kPa (0 to 1435 psig), preferably 500 to 2000 kPa (58 to 275 psig); hydrogen partial pressures of 50 to 5000 kPa (−8 to 710 psig), preferably 500 to 1000 kPa (58 to 130 psig); space velocities of 0.2 to 20 WHSV, preferably 0.5 to 2 wHSV.

The product of hydrogenation comprises the desired aromatic amines, water and heavy amines. The aromatic amines include C6 to C9 amines such as aniline, toluidine, xylidene, or methylanilines. The heavy amines comprise C10+ monoamines and/or C7+ diamines with C6 to C9 hydrocarbon aromatic rings.

The water and heavy amines are removed from the product mixture by any suitable means, e.g, distillation. Water is distilled off the top of a distillation column and the heavy amine bottoms are removed. The resulting aromatic amines-containing product can be used directly in blending gasolines.

The product of amination can be characterized by a significantly increased octane rating. A comparison of octane ratings for naphthenes, aromatic hydrocarbons and their corresponding amines is set out below in Table 4.

TABLE 4

Octane Values of Naphthenes, Aromatics and Aromatic Amines

| Compound | RON + O | MON + O | R + M/2 |
|---|---|---|---|
| Methylcyclohexane (ASTM Values) | 74 | 74 | 74 |
| 1,trans-2-Dimethylcyclohexane (ASTM Values) | 72 | 71 | 71 |
| Toluene (ASTM Values) | 120 | 109 | 114 |
| meta-Xylene (ASTM Values) | 118 | 115 | 116 |
| 2-Methylaniline* | 247 | 197 | 222 |
| 2,4-Dimethylaniline* | 297 | 187 | 242 |

*Octane data for aromatic amines is based on a 1.0 wt % blend with premium base fuel (96.6 RON + O, 87.1 MON + O).

After separating out the amination by-products such as water and heavy amines, the aminated product can be added to the refinery gasoline pool. In those instances above where a full-range naphtha or reformate is fractionated into light, medium and heavy fractions, wherein the medium fraction alone is subjected to amination treatment, the light and/or heavy fractions may also be added to the refinery gasoline pool.

A simplified schematic flowsheet of the present process is shown in FIG. 1. A C5 to C12 Arab Light Naphtha feed fraction is introduced through conduit 101 to fractionator 102 where it is resolved into light, medium and heavy fractions. The light fraction is passed as overhead through conduit 103 to a paraffin isomerizer 104 wherein normal C5 and C6 hydrocarbons are converted to higher octane branched C5 and C6 hydrocarbons which are passed through conduit 105 to the refinery gasoline pool 106. The heavy fraction comprising C9+ PNA (paraffins, naphthenes, and aromatics) is passed from the fractionator bottom through conduit 107 to the refinery gasoline pool 106. The medium fraction comprising C8- aromatics is passed through conduit 108 to nitration zone 109 wherein a nitrating agent comprising nitric acid, sulfuric acid and water is added through conduit II0. The nitrated product can, if necessary, be further treated by a suitable process such as distillation to remove any unwanted by-products such as dinitrohydrocarbons and is thence passed through conduit 111 to hydrogenation zone 112 where it is contacted with hydrogen introduced through conduit 113 and a nickel hydrogenation catalyst such as Raney nickel. The hydrogenation is carried out under conditions sufficient to effect reduction of nitroaromatics to aromatic amines. The effluent from the hydrogenation zone which comprises aromatic amines and by-product water and heavy amines such as C6+ diamines and C9+ monoamines is passed through conduit 114 to a distillation column 115 wherein said effluent is heated to drive off water which is removed as overhead through conduit 116 while heavy amines are removed as bottoms through conduit 117. The thus-separated aromatic amine-containing product of enhanced octane is then passed to the refinery gasoline pool 106 via conduit 118.

Figure 2:
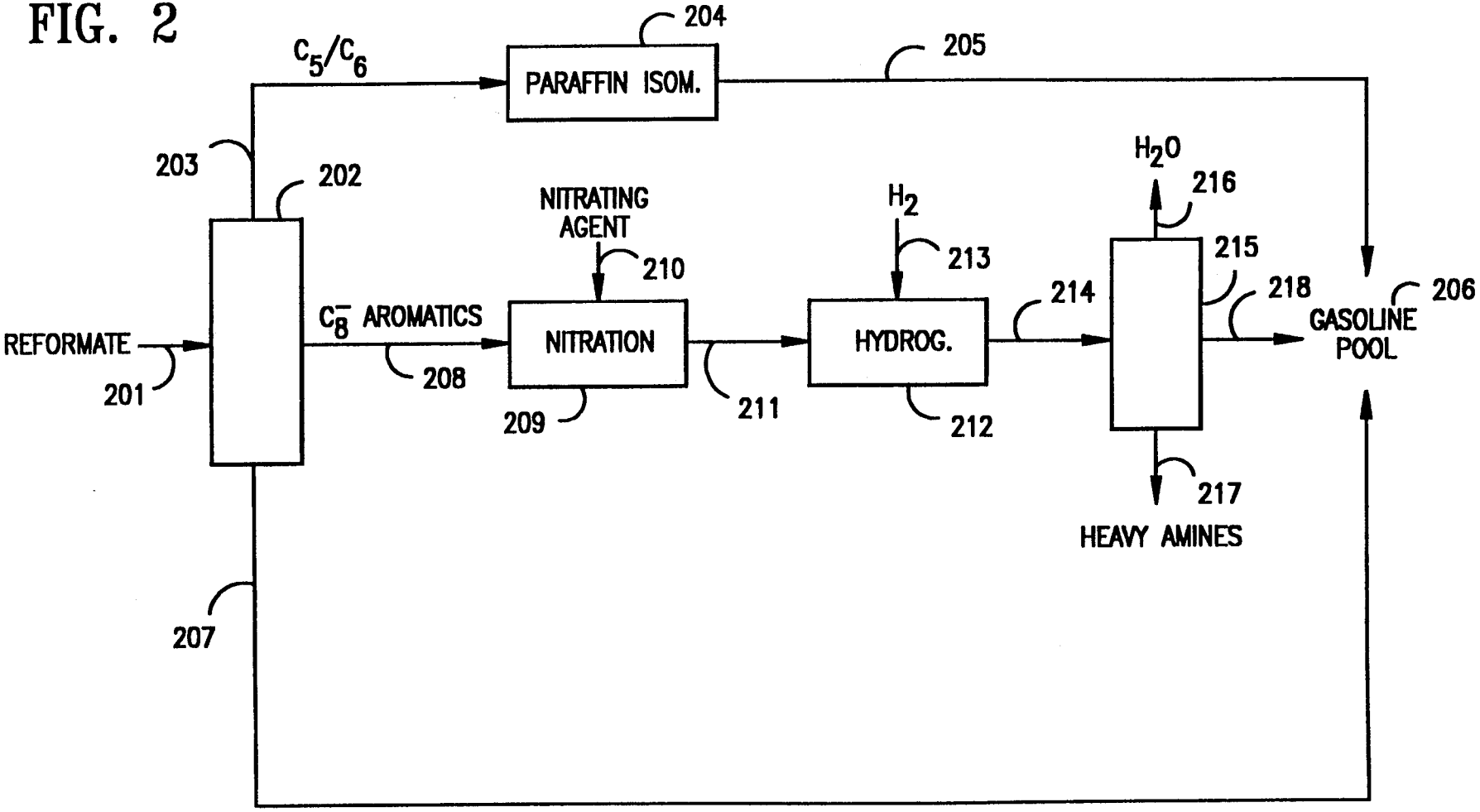
FIG. 2 is a simplified schematic flowsheet of one embodiment of the present gasoline upgrading process wherein reformate is upgraded by amination.

A second variation of the present process is shown in FIG. 2 wherein reformate octane values are increased without affecting reformer operation or increasing aromatics content. A full range reformate fraction is introduced through conduit 201 to fractionator 202 where it is resolved into light, medium and heavy fractions. The light fraction is passed as overhead through conduit 203 to a paraffin isomerizer 204 wherein saturated C5 and C6 hydrocarbons are converted to higher octane branched C5 and C6 hydrocarbons which are passed through conduit 205 to the refinery gasoline pool 206. The heavy fraction comprising C9+ PNA is passed from the fractionator bottom through conduit 207 to the refinery gasoline pool 206. The medium fraction comprising about 90 wt% C6-C8 aromatics is passed through conduit 208 to nitration zone 209 wherein a nitrating agent comprising nitric acid, sulfuric acid and water is added through conduit 210. The nitrated product is thence passed through conduit 211 to hydrogenation zone 212 where it is contacted with hydrogen introduced through conduit 213 and a nickel hydrogenation catalyst. The hydrogenation is carried out under conditions sufficient to effect reduction of nitroaromatics to aromatic amines. The effluent from the hydrogenation zone which comprises aromatic amines and by-product water and heavy amines such as C9+ monoamines and C7+ diamines is passed through conduit 214 to a distillation column 215 wherein said effluent is heated to drive off water which is removed as overhead through conduit 216 while heavy amines are removed as bottoms through conduit 217. The thus-separated aromatic amine-containing product of enhanced octane is then passed to the refinery gasoline pool 206 via conduit 218. The aminated reformate can be combined with the light fraction and heavy fraction to form a gasoline pool component having an aromatics content no greater than, and an octane number greater than, the full range reformate charge composition.

Figure 3:
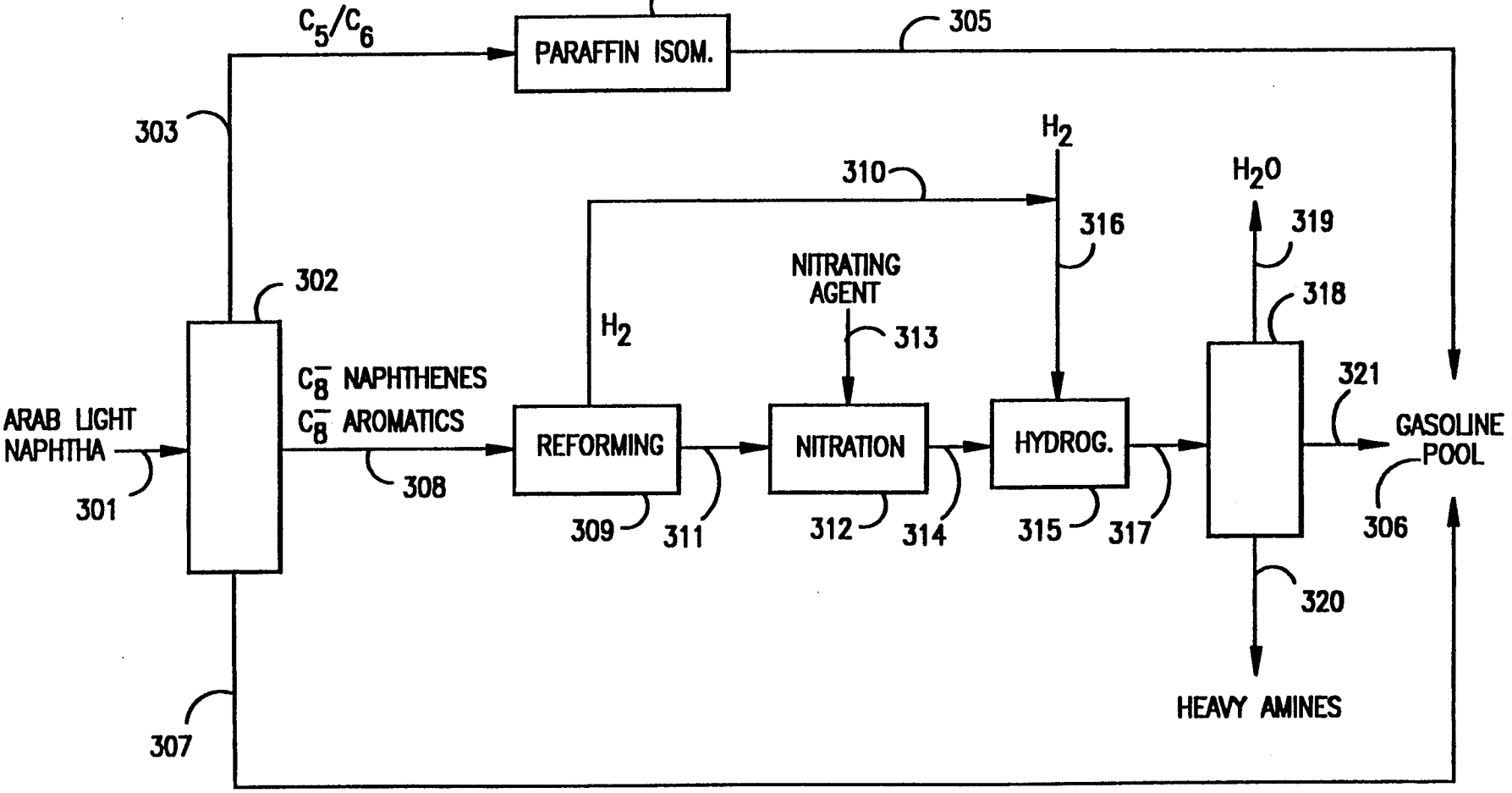
FIG. 3 is a simplified schematic flowsheet of another embodiment of the present gasoline upgrading process wherein a naphtha is reformed and thereafter aminated by nitration and hydrogenation, using reformer hydrogen.

A third variation of the present process is shown in FIG. 3 wherein full range naphtha octane values are increased by a combined low severity reforming-aminating process. A full range Arab Light naphtha reformate is introduced through conduit 301 to fractionator 302 where it is resolved into light, medium and heavy fractions. The light fraction is passed as overhead through conduit 303 to a paraffin isomerizer 304 wherein saturated C5 and C6 hydrocarbons are converted to higher octane branched C5 and C6 hydrocarbons which are passed through conduit 305 to the refinery gasoline pool 306. The heavy fraction comprising C9+ PNA is passed from the fractionator bottom through conduit 307 to the refinery gasoline pool 306. The medium fraction comprising approximately 21 wt% C8- naphthenes and 17 wt% C8- aromatics is passed through conduit 308 to low severity reforming zone 309 wherein the naphthenes in the medium fraction are dehydrogenated to aromatics with by-product hydrogen being taken off through conduit 310. The low severity reformate is passed through conduit 311 to nitration zone 312 wherein a nitrating agent comprising nitric acid, sulfuric acid and water is added through conduit 313. The nitrated product can, if necessary, be further treated to remove any unwanted by-products and is thence passed through conduit 314 to hydrogenation zone 315 where it is contacted with hydrogen, including the by-product hydrogen from conduit 310, introduced through conduit 316 and a nickel hydrogenation catalyst.

The hydrogenation is carried out under conditions sufficient to effect reduction of nitroaromatics to aromatic amines. The effluent from the hydrogenation zone which comprises aromatic amines and by-product water and heavy amines such as C9+monoamines and C7+diamines is passed through conduit 317 to a distillation column 318 wherein said effluent is heated to drive off water which is removed as overhead through conduit 319 while heavy amines are removed as bottoms through conduit 320. The thus-separated aromatic amine-containing product of enhanced octane is then passed to the refinery gasoline pool 306 via conduit 321.

As shown above, the present invention can be used to prepare hydrocarbon fuel compositions boiling in the gasoline boiling range which comprise aminated reformate. The aminated reformate can be added in amounts sufficient to increase octane rating (R+M)/2. Generally, such amounts range from 0.1 to 10 wt% aminated reformate, preferably 1 to 5 wt%, for example, 1 to 2 wt%.

EXAMPLES

Example 1

Small-Scale Preparation of Aminated Reformate Nitration

Conversion of aromatics in a reformate to nitrated aromatics was performed in a 3 liter round bottom flask, which was fitted with a mechanical stirrer and cooled with an ice bath. 250 g of reformate (63.8 wt% aromatics) were then added to the flask and allowed to cool to 10° C. (50° F.). In a separate flask, 20 cc of water, 104 cc sulfuric acid (97%), and 62 cc nitric acid (70%) were mixed and cooled to 10° C. (50° F.). The acid solution was then added dropwise to the reformate in 90 minutes. Acid flow was occasionally suspended during the addition period to insure that the temperature of the reaction mixture remained below 16° C. (60° F.). After completing the acid addition, the reaction was allowed to proceed for 30 minutes more, at which time the reaction was quenched by pouring the reaction mixture into a separatory funnel and adding 200 cc of crushed ice. The bottom (aqueous) layer was then drawn off and discarded. The hydrocarbon phase was neutralized with 200 cc of saturated sodium carbonate solution. After again discarding the aqueous phase, the nitrated product was dried over magnesium sulfate before recovery.

In order to minimize the formation of undesirable dinitrated aromatics, the temperature during nitration never exceeded 16° C. (60° F.). The amount of nitric acid added in the initial reaction step was limited so that 50% of the aromatics would undergo nitration. Analysis of the final product by gas chromatography/mass spectroscopy showed little evidence of aromatic diamines. The nitration temperature was also low enough to suppress the formation of sulfonated aromatics and nitrated aliphatic hydrocarbons.

Hydrogenation

Hydrogenation of the nitrated intermediate to the aminated product was performed in a 300 cc autoclave. Using 100 g of nitrated reformate, 100 grams isopropanol (0.1 wt% water), and 5 g of 1% Pd/activated carbon catalyst (Aldrich), the reduction step was accomplished, following adequate purging with nitrogen, using 2200 kPa (300 psig) hydrogen. The hydrogen flow was adjusted so as to maintain a reactor temperature below 49° C. (120° F.). Infrared analysis indicated that the hydrogenated product contained no nitrated aromatics. Vacuum distillation of this liquid resulted in a final product free of isopropanol and water.

In the conversion of nitrated aromatics to aminated aromatics, the reaction temperature was kept relatively low to prevent saturation of the aromatic rings on the palladium catalyst which can cause dramatic losses in blending octane value.

Gasoline Blend

The aminated reformate, containing 9.3 wt% nitrogen, was blended with a conventional gasoline. As shown in Table 5 below, the road octane value of premium base fuel was increased from 91.8 to 92.8 R+M/2 with the addition of 1.0 wt% aminated reformate. Assuming a linear blending calculation, this octane boost corresponds to a road blending octane of 192 for aminated reformate. An octane enhancement of 1.8 R+M/2 was achieved with 2.0 wt% aminated reformate in premium base fuel, which translates to a blending octane of 182. The octane response obtained with the addition of aminated reformate agrees well with addition of pure aromatic amines which have road octane values ranging from 177 for 2,6-xylidene to 262 for aniline. On a nitrogen basis, the aminated reformate has as much octane potential as the pure aromatic amines.

TABLE 5

Effect of Aromatic Amines on Octane

| Compound | Wt % | RON + O | MON + O | Blending R + M/2 |
|---|---|---|---|---|
| Aminated Reformate | 1.0 | 98.0 | 87.7 | 192 |
| | 2.0 | 99.0 | 88.3 | 182 |
| Aniline | 1.0 | 98.4 | 88.7 | 262 |
| | 2.0 | 99.3 | 89.5 | 220 |
| o-Toluidine | 1.0 | 98.1 | 88.2 | 222 |
| | 2.0 | 99.2 | 88.7 | 197 |
| 2,4-Xylidene | 1.0 | 98.6 | 88.1 | 242 |
| | 2.0 | 99.9 | 88.8 | 217 |
| 2,6-Xylidene | 1.0 | 98.2 | 87.6 | 197 |
| | 2.0 | 99.3 | 87.8 | 177 |

EXAMPLE 2

Larger-Scale Preparation of Aminated Reformate

Nitration $C_5$−171° C. (340° F.) reformate whose composition is set out in Table 6 below, containing 73.2 wt% aromatics was nitrated in a 5 liter round bottom flask fitted with a mechanical stirrer and cooled with an ice bath. 1000 g of reformate were added to the flask and cooled to 4° C. (40° F.). In a separate flask maintained at 4° C. (40° F.), 115 cc of water, 597 cc sulfuric acid (97%), and 356 cc nitric acid (70%) were mixed. Cooling was required due to the highly exothermic nature of mixing sulfuric acid and water. The amount of nitric acid employed in this method was sufficient to nitrate 80% of the aromatic rings in the reformate. Sulfuric acid served as catalyst, generating nitronium ions from the nitric acid, as well as dessicant, since water produced during the reaction inhibits nitration. The acid solution was added to the reformate over the course of two hours. Acid flow was occasionally suspended during the addition period to insure that the temperature of the reaction mixture remained below 16° C. (60° F.). completing the acid addition, the reaction was allowed to proceed 69 minutes more, at which time the nitration was quenched by pouring the reaction mixture into a separatory funnel and adding 500 cc of crushed ice. The bottom (aqueous) layer was then drawn off and discarded. The hydrocarbon phase was neutralized with 1000 cc of saturated sodium carbonate solution. After again discarding the aqueous phase, the nitrated product was dried over magnesium sulfate before recovery. Using this method, seventy batch runs were performed, with the nitrated reformate intermediate containing 5.7±0.3 wt% nitrogen.

TABLE 6

Reformate Composition (100.7 RON + O, 89.5 MON + O)

| Aromatics | (wt %) |
|---|---|
| Benzene | 3.3 |
| Toluene | 22.2 |
| Total C8 | 26.8 |
| Total C9 | 15.3 |
| Total C10+ | 5.6 |
| Paraffins + Naphthenes | |
| Total C4 | 0.6 |
| Total C5 | 10.7 |
| Total C6 | 8.0 |
| Total C7 | 6.3 |
| Total C8+ | 1.2 |
| Simulated Distillation | °F. |
| IBP | 99 |
| 25 wt % | 195 |
| 50 wt % | 263 |
| 75 wt % | 287 |
| 95 wt % | 342 |

Hydrogenation

Reduction of the nitrated intermediate was performed in a 2 gallon batch autoclave. Each hydrogenation run utilized 2.2 liters of nitrated reformate, 2.2 l of isopropanol (0.1 wt% water), and 50 g of 1% Pd/activated carbon catalyst. The addition of alcohol to the reactor was necessary to prevent poisoning of the catalyst by the aromatic amine products. Isopropanol was chosen on the basis of safety, cost, and azeotropic properties. Since the addition of the palladium/activated carbon solid to alcohol was exothermic, the catalyst was slurried with 100 cc of water and 100 cc of isopropanol prior to its loading in the autoclave. Following the addition of the liquids and catalyst, the reactor was carefully purged with nitrogen before being pressurized to 2200 kPa (300 psig) with hydrogen. The gas flow was then stopped for 30 minutes to insure that a rapid uptake of hydrogen, and consequently a large exotherm, did not occur. Following this pause, a hydrogen flow of $1.89\times10^{-4}$ m3/s (0.40 scfm) through the reactor was established at 2200 kPa (300 psig). Using neither cooling nor heating, the reactor temperature followed a distinct pattern. After initiating the hydrogen flow, the temperature increased from 25° to 43° C. (77° to 110° F.) over roughly 8 hours, followed by a rapid temperature rise to approximately 200° F. during the next 60 minutes. Infrared analysis of the hydrogenation product indicated that high conversions (>99%) were reached when the reactor temperature followed these trends. The liquid would remain at this high temperature for 2 hours, then slowly cool at about 8° C./h (15° F./h). To end the 20 hour run, the reactor temperature was lowered to 25° C. (77° F.) using cooling water and the hydrogen flow replaced with nitrogen. Following careful purging, the reactor was emptied and the catalyst filtered out of the opaque product liquid. Each batch of aminated reformate/isopropanol solution was analyzed by IR to confirm that a high level (>99%) of nitrated aromatic conversion had been reached.

Distillation:

The final aminated reformate sample was recovered from the hydrogenation product through distillation in two 61 l (16 gallon) stills. 151 l (40 gallons) of aminated reformate/isopropanol solution were mixed with 19 l (5 gallons) of a synthetic lubestock, which were added to prevent the formation of tar in the still pots, to obtain a total of 132 kg (290.7 lbs) of charge stock. 56 l (15 gallons) of liquid were initially charged to each still. Atmospheric distillation was then performed to remove 28 l (7.5 gallons) of the original chargestock before resuming the atmospheric distillation. During both phases of this initial step, column temperatures remained near 82° C. (180° F.), which is close to the boiling point of isopropanol and the isopropanol/water azeotrope, for much of the time. The atmospheric distillation was stopped when the pot temperatures reached 121° C. (250° F.), at which time the column temperatures were between 82° and 85° C. (180° and 185° F.). The yield of this atmospheric overhead, which consisted primarily of isopropanol, water, and unreacted reformate, was 93 l (24.6 gallons) (63.5 wt%) and contained only 110 ppm nitrogen. After cooling the pots to 32° C. (90° F.), vacuum distillation was started, with the pressures dropping to 7 and 11 mm Hg within the two stills. The aminated reformate was collected as the 149° to 227° C. (300° to 440° F.) cut of the vacuum overhead, with 28 l (7.5 gallons) (20.2 wt%) recovered.

The yield of aminated reformate from 70 kg of reformate was 26.7 kg of 149° to 227° C. product (9.5 wt%). Higher overall yields are obtainable where a narrow reformate cut consisting primarily of C6 to C8 aromatics is employed.

Very high blending octane values were observed with the aminated reformate product. As shown in Table 7, the addition of 1.0 wt% aminated reformate (950 ppm nitrogen) to a premium base (96.6 RON+0, 87.1 MON+0) increased the (R+M)/2 value by 1.35 numbers. This enhancement translates to blending octane values of 227 (weight basis) and 261 (volume basis). The difference in blending octane numbers is a result of the higher density of aminated reformate (0.938 g/cc) as compared to the base fuel (0.75 g/cc). Assuming a linear blending response, 7.4 vol% MTBE (methyl tert-butyl ether) would be required to attain the same octane enhancement as 1.0 wt% aminated reformate. Increases in both research and motor octane values obtained with the aminated reformate of Example 2 actually exceeded those from the smaller scale preparation of Example 1, possibly the result of removing the heavy (C10+) aromatic amines.

TABLE 7

Effect of Aminated Reformate on Octane

| Compound | Wt % | Added N | Δ RON + O | Δ MON + O | Δ R + M/2 | Blending R + M/2 |
|---|---|---|---|---|---|---|
| Aminated Reformate | 1.0 | 950 ppm | 1.6 | 1.1 | 1.35 | 261 |
| (EX. 2) | 2.0 | 1900 | 3.0 | 2.2 | 2.6 | 254 |
| Aminated Reformate | 1.0 | 930 ppm | 1.4 | 0.6 | 1.0 | 225 |
| (EX. 2) | 2.0 | 1860 | 2.4 | 1.2 | 1.8 | 212 |
| Aniline | | | 1.0 | 98.4 | 88.7 | 262 |
| | | | 2.0 | 99.3 | 89.5 | 220 |
| o-Toluidine | | | 1.0 | 98.1 | 88.2 | 222 |
| | | | 2.0 | 99.2 | 88.7 | 197 |
| 2,4-Xylidene | | | 1.0 | 98.6 | 88.1 | 242 |
| | | | 2.0 | 99.9 | 88.8 | 217 |
| 2,6-Xylidene | | | 1.0 | 98.2 | 87.6 | 197 |
| | | | 2.0 | 99.3 | 87.8 | 177 |

The removal of the 227° C+(440° F.+) fraction from the large batch also had positive effects on solubility. Blending studies revealed that at least 10 wt% of 149° to 227° C. (300° to 440° F.) aminated reformate could be dissolved in premium gasoline, while addition of 5 wt% 149° C.+(300° F.+) product resulted in the appearance of two phases.

The aminated reformate of Example 2 was characterized using gas chromotography (GC), GC/Mass Spectroscopy, and NMR techniques. As shown in Table 8, the aromatic amine fraction (76 wt%) consisted of primarily methyl- and dimethylanilines, with some C9 components, but no aniline. The absence of this C6 amine in the final product is not surprising in light of the synthetic procedure employed. The rate of aromatic nitration increases with the amount of alkyl groups on the aromatic ring. Therefore, heavier aromatics in the reformate reacted before lighter ones. Combining this trend with the low level of benzene (3 wt%) in the starting reformate and the limited extent of nitration (80%) in the first synthetic step, it is not surprising that aniline was not detected in the final product. Characterization also revealed that significant amounts of unreacted aromatics remained in the aminated reformate, which explains why the nitrogen content (9.5 wt%) was below that of pure aromatic amines. Complete conversion of aromatics in reformate to the corresponding aromatic amines would almost certainly yield a product with blending octane values exceeding those found with this large-scale batch.

TABLE 8

Properties of Aminated Reformate

| | |
|---|---|
| Density | 0.938 g/cc |
| Nitrogen Content | 9.5 wt % |
| Composition, wt % | |
| Methylanilines | 31.6 |
| C8 Aromatic Amines | 35.7 |
| C9 Aromatic Amines | 8.8 |
| Isopropanol, C7-HC | 0.4 |
| C8 Aromatics | 5.0 |
| C9 Aromatics | 13.6 |
| C10 Aromatics | 3.1 |
| Heavies (440° F.+) | 1.8 |

TABLE 8-continued

| Properties of Aminated Reformate | |
|---|---|
| Simulated Distillation | °F. |
| IBP | 230 |
| 25 wt % | 376 |
| 50 wt % | 402 |
| 75 wt % | 426 |
| 95 wt % | 443 |

We claim:

1. A method for upgrading an aromatics-containing charge composition boiling in the gasoline boiling range which comprises:

a) separating said charge composition into a light fraction containing saturated C5 and C6 hydrocarbons; a medium fraction containing C6–C8 aromatics and a heavy fraction containing C9+aromatics;

b) nitrating said medium fraction by contacting with a nitrating agent under nitrating conditions to form a product comprising nitrated aromatic;

c) hydrogenating the product of b) under conditions sufficient to substantially reduce the nitro group of said nitrated aromatics so as to form a product comprising aromatic amines, water and heavy amines; and d) removing said water and heavy amines from the product of step c) so as to form a product boiling int eh gasoline boiling range which comprises aromatic amines.

2. The method of claim 1 wherein said product of step d) is combined with said light fraction and heavy fraction to form a gasoline pool component having an aromatics content no greater than, and an octane number greater than, that of said charge composition.

3. The method of claim 2 wherein said light fraction is subjected to paraffin isomerization conditions and said medium fraction contains at least 10 wt% aromatic hydrocarbons.

4. The method of claim 1 wherein said nitrating agent is selected from the group consisting of $HNO_3$ and nitrogen dioxide.

5. The method of claim 1 wherein said nitrating is carried out under homogeneous conditions comprising temperatures of −20 to 120° C., using sulfuric acid catalyst.

6. The method of claim 1 wherein said nitrating is carried out under heterogeneous conditions comprising temperatures of 0° to 150° C., using a zeolite catalyst.

7. The method of claim 1 wherein said charge composition is a reformate.

8. A method of upgrading the octane rating of an aromatics-containing charge composition boiling in the gasoline boiling range which comprises:

I) separating the charge composition into a light fraction containing saturated C5 and C6 hydrocarbons; a medium fraction containing C6–C8 paraffins; C6–C8 aromatics and C6–C8 naphthenes and a heavy fraction containing C9+ paraffins, naphthenese, and aromatics;

II) reforming the medium fraction under low severity conditions sufficient to effect dehydrogenation of said naphthenes to aromatics without dehydrocyclization of paraffins;

III) contacting the product of II), with nitrating agent under nitrating conditions to form a product comprising nitrated aromatics;

IV) hydrogenating the product of III) under conditions sufficient to substantially reduce the nitro group of the nitrated aromatics so as to form a product comprising aromatic amines, water and heavy amines; and V) removing said water and heavy amines from the product of step IV) so as to form a product boiling in the gasoline boiling range which comprises aromatic amines.

9. The method of claim 8 wherein said hydrogenating employs hydrogen produced by said reforming of the medium fraction and the light fraction, heavy fraction and product of step V) are added to a refinery gasoline pool.

10. The method of claim 9 wherein the light fraction is subjected to paraffin isomerization conditions.

* * * * *

UNITED STATES PATENT AND TRADEMARK OFFICE

CERTIFICATE OF CORRECTION

PATENT NO. : 5,284,984

DATED : February 8, 1994

INVENTOR(S) : Ralph M. Dessau et al

It is certified that error appears in the above-identified patent and that said Letters Patent is hereby corrected as shown below:

Column 13, Line 21, "aromatic" should read --aromatics--.

Column 13, Line 29, "int eh" should read --in the--.

Column 14, Lines 17-18, "naphthenese" should read --naphthenes--.

Signed and Sealed this

Fifth Day of July, 1994

*Attest:*

*Attesting Officer*

BRUCE LEHMAN

*Commissioner of Patents and Trademarks*